US007201224B2

(12) United States Patent
Corvera-Poire et al.

(10) Patent No.: US 7,201,224 B2
(45) Date of Patent: Apr. 10, 2007

(54) DYNAMIC REDUCTION OF THE MOISTURE LAYER DURING THE DISPLACEMENT OF A VISCOELASTIC FLUID USING A FLUID WITH LOWER VISCOSITY

(76) Inventors: Eugenia Corvera-Poire, Jose de Teresa 299-3, Colonia Campestre Churusbusco, Mexico, D.F.C.P. 01040 (MX); Mariano Lopez de Haro, Jose de Teresa 299-3, Colonia Campestre Churusbusco, Mexico, D.F.C.P. 01040 (MX); Jesus Del Rio Portilla, Jose de Teresa 299-3, Colonia Campestre Churusbusco, Mexico, D.F.C.P. 01040 (MX)

( * ) Notice: Subject to any disclaimer, the term of this patent is extended or adjusted under 35 U.S.C. 154(b) by 293 days.

(21) Appl. No.: 10/484,778

(22) PCT Filed: Jul. 22, 2002

(86) PCT No.: PCT/MX02/00068

§ 371 (c)(1),
(2), (4) Date: Jul. 23, 2004

(87) PCT Pub. No.: WO03/015911

PCT Pub. Date: Feb. 27, 2003

(65) Prior Publication Data

US 2005/0028971 A1 Feb. 10, 2005

(30) Foreign Application Priority Data

Jul. 23, 2001 (MX) ..... PA/a2001/007424

(51) Int. Cl.
*E21B 43/00* (2006.01)

(52) U.S. Cl. ..... 166/249

(58) Field of Classification Search ..... None
See application file for complete search history.

(56) References Cited

U.S. PATENT DOCUMENTS 3,754,598 A * 8/1973 Holloway, Jr. ..... 166/249
4,345,650 A * 8/1982 Wesley ..... 166/249
4,417,621 A * 11/1983 Medlin et al. ..... 166/249
4,646,834 A * 3/1987 Bannister ..... 166/291

* cited by examiner

*Primary Examiner*—Frank Tsay
(74) *Attorney, Agent, or Firm*—Hoffman, Wasson & Gitler

(57) ABSTRACT

The invention relates to a method of optimizing the displacement of a viscoelastic fluid in a pore, tube, duct, channel, fracture, porous medium or interconnected lattice-work or in an interconnected assembly of pores, tubes, ducts, channels, cavities and/or fractures using a fluid with a lower viscosity. The inventive method consists in displacing the viscoelastic fluid using a displacing fluid which supplies a signal thereto comprising pressure pulses at an optimum frequency. In this way, the moisture layer between the displaced fluid and the walls of the pores, tubes, channels, cavities, fractures or porous medium is dynamically reduced during said displacement, thereby facilitating optimum extraction.

9 Claims, No Drawings

DYNAMIC REDUCTION OF THE MOISTURE LAYER DURING THE DISPLACEMENT OF A VISCOELASTIC FLUID USING A FLUID WITH LOWER VISCOSITY

A) BACKGROUNDS

When a low viscosity fluid drives a high viscosity fluid, the interphase between both fluids is not flat, rather becomes unstable and creates structures called viscous fingers. In a pore, tube or channel when a viscous fluid is driven under constant flow or constant pressure gradient by a lower viscosity fluid, the driving fluid penetrates the driven fluid forming a front in the shape of a single finger within the driven fluid leaving a viscous fluid layer "glued" to the walls of the pore, tube or channel.

Fluid behavior inside tubes, Hele-Shaw cells and porous medium is described by Darcy'Law, which relates fluid pressure and velocity through fluid permeability in the medium, therefore the results obtained in tubes and Hele-Shaw cells extrapolate with minor modifications to porous media.

B) STATE OF THE ART

On the other hand, it is known that when pressure pulses are passed through a viscoelastic fluid contained in a tube or porous medium at optimal frequency, flow ratio is considerably increased. This is because permeability has maxima at certain frequencies. In the present invention, the frequency giving maximun permeability is called optimum frequency. In this matter, there are two bibliographic references: *Transport in Porous Media* 25, 167 (1996), and PRE 58, 6323 (1998).

Also it is known that in porous media, when pressure pulses are passed through the fluid contained in the porous medium, the flow ratio considerably increases. Above has been applied in oil wells U.S. Pat. No. 6,241,019,

DEFINITIONS

In the context of this patent, the following words and phrases must be understood as follows:

fluid: gas, liquid, gel or any state of the matter able to flow.

driven fluid: fluid to be displaced, contained inside the pore, tube, duct, channel, fracture, interconnected latticework of pores, tubes, channels, cavity, and/or fractures or porous medium.

driving fluid: fluid that is used to drive or transmit pressure pulses to the driven fluid.

interphase: frontier between driven fluid and driving fluid. In the case of totally immiscible fluids, this interphase will be well located in the space. In the case of partially miscible fluids, the interphase will be diffuse, i.e., the frontier between the driven fluid and the driving fluid will have a certain width.

viscous finger: structure that is formed in the interphase between the driven fluid and the driving fluid. Its shape is that of a finger, that is why its name.

moisture layer: viscous fluid layer that is "glued" to the walls of the medium where that fluid is contained which is to be driven. Quotation marks in "glued" refers to layer remains immobile and, therefore, fluid contained in that layer can not driven.

viscous fluid: fluid with viscosity other than zero.

viscoelastic fluid: a viscous fluid with elastic properties.

porous medium: material having a matrix that can be rigid or flexible, and a interconnected latticework of pores, holes, fractures, cavities and channels. Such pores latticework can contain fluids, and these fluids can be driven through the latticework. The matrix can be solid, as in the case of rocks, or fluid, as in the case of cellular membranes. The porous medium can be natural or manufactured. Examples of natural porous mediums are the cellular membranes, animal tissues, sponges, rocks, sands, clays and naturally fractured oil deposits. Samples of porous mediums are artificial sponges, strainers, filters, distillation columns, molecular sieves, and fabrics. In most cases, the porous medium matrix exists independently of the interconnected latticework of pores having or not fluid, however, there are cases in which the matrix is formed precisely by contact with the fluid contained in the interconnected latticework of pores, as in the case of phases formed by polymer chains with hydrophobic ends which are associated between each other through water contact, yielding the polymer matrix and the interconnected pores lattice.

flow ratio: amount of material that flows per time unit.

Hele-Shaw cell: quasi-bi-dimensional channel formed by two plates separated by a very small distance compared with the plates dimensions. The cell has a fluid that can be driven. When a second fluid is injected through one of the ends, it is called rectangular Hele-Shaw cell.

optimum frequency: frequency that gives maximum value of permeability.

permeability: measurement of ease with which a fluid flows in a medium, and generally depends both on the medium'geometry as on the fluid characteristics that is driven therein. In general, permeability is a dynamic function that depends of frequency.

signal: refers to a pressure wave that can be periodic or non-periodic, continuous or episodic and can be of a single frequency or many.

C) DETAILED DESCRIPTION OF THE INVENTION

This invention refers to the dynamic reduction of the moisture layer during displacement of a viscoelastic fluid between itself and the walls of the medium containing it, when the driving fluid has viscosity lower than the driven fluid. The displacement method consists in the low viscosity fluid injection in order to displaces the viscoelastic fluid with a signal containing pressure pulses at a certain optimum frequency, or in the production of a signal having such pressure pulses within or outward of the low viscosity fluid, so it communicates them to the viscoelastic fluid when it is driven, with the corresponding injection of low viscosity fluid, to replace the volume of driven fluid.

The pressure pulses can be generated by mechanical, electro mechanical, hydraulic, pneumatic, magnetic, optic, acoustic, thermo-acoustic means, or any medium generating vibrations The pressure pulses can be generated by injecting at optimum frequency the driving fluid.

The signal sent by the driving fluid to the driven fluid, can consist of: mere pressure pulses at the optimum frequency; a constant flow signal on which are overlapped pressure pulses at the optimum frequency; a constant pressure gradient signal on which are overlapped pressure pulses at the optimum frequency, any signal in which are overlapped pressure pulses at the optimum frequency. In all cases the signal must be applied in a way it travels in the direction of the fluid displacement.

The efficiency of this invention will be better when the (walls area/medium volume) ratio is large.

To find the optimum frequency, the geometry and size of the pore, pipe, duct, channel, fracture or interconnected latticework of pores, tubes, ducts, channels, cavities and/or fractures must be known, as well as the elastic characteristics of the fluid to be driven, its viscosity and density. In the case of porous media, enough will be to know the statistic properties of the pores geometry, as well as the elastic characteristics of the fluid that must be driven, its viscosity and its density.

Dynamic reduction of the moisture layer during the displacement of a viscoelastic fluid by a lower viscosity fluid, in particular can be applied, but not exclusively to the following technologies.

Oil recovery in apparently extinguished wells, that have been worked using different methods to the displacement by pressure pulses.

Fluids flow of fluids or fluids and solids mixture during oil extraction in porous media, as long as the fluid or fluids and solids mixture bearing viscoelastic characteristics.

Fluids flow of fluids or fluids and solids mixture in: pipes used in chemical engineering processes, filtering, column distillation, cleaning, refining, or other processes where viscoelastic fluids or fluids and solids mixtures with viscoelastic characteristics, flow from one point to another under pressure gradient influence or under gravity influence, including processes in foodstuff, pharmacy and cosmetology industries.

Aquifer strata cleaning by non-aqueous substances.

D) EXAMPLE

The following example shows a particular case, how the moisture layer dynamically decreases when a fluid is driven to the optimum frequency. This example is shown to illustrate how the moisture layer width relates with the optimum frequency in a particular geometry, and by no means, the general validity of our claims is excluded. The example was also chosen because the equation for fluids behavior in porous media, is the same for fluids behavior in Hele-Shaw cells.

For example, lets consider a Maxwell fluid, which is one of simplest models of viscoelastic fluids, being driven in a rectangular Hele-Shaw cell. The flow of the viscoelastic fluid is described by following equation:

$$\rho t_r \frac{\partial^2 \vec{v}}{\partial t^2} + \rho \frac{\partial \vec{v}}{\partial t} = -\nabla p - t_r \frac{\partial \nabla p}{\partial t} + \eta \nabla^2 \vec{v} \tag{1}$$

Solving this equation in the frequency domain for a homogeneous flow in the x direction, under the frontier conditions: velocity becomes zero in the parallel plates that located in z=±1.

Averaging in the z direction to obtain the average flow, a generalized Darcy Law of the form is obtained:

$$\langle v \rangle = -\frac{K(\omega)}{\eta} \frac{dp}{dx} \tag{2}$$

Wherein permeability K(ω) has maximum values at certain frequencies. In the equation (2) velocity and pressure are in the frequencies domain. Corresponding frequencies to the largest value K(ω) for this example, vary between 1 Hz and 30 Hz, depending of viscosity, density, plates separation and the time of relaxation of the fluid being considered. Two specific examples are: for the time of relaxation values, viscosity, density and separation between plates of $t_r$=6s, η=0.7p, ρ=1 g/cm$^3$, b=1 mm the frequency that maximizes permeability is close to 2 Hz and for the time of relaxation values, viscosity, density and separation between plates of $t_r$1=s, η=10p, ρ=1 g/cm$^3$, b=1 mm the frequency that maximizes permeability is close to 20 Hz.

Now lets consider the case of a fluid with minor viscosity that displaces the viscoelastic fluid. We consider the case of immiscible fluids. We analyze the case of a single l width finger in units of width of the cell, displacing with U velocity within the viscoelastic fluid. The amount U/l yields a characteristic frequency. On the other hand, the viscoelastic fluid also has a characteristic frequency 1/tr. When U/l>1/tr, the viscoelastic fluid behaves as a solid and there is not instability. The smaller possible width finger corresponds to:

$$\frac{U}{\lambda} = \frac{1}{t_r} \tag{3}$$

On the other hand, the matter conservation implies that λ=V/U. Far away of the finger the velocity satisfies the derivate equation for the uniform flow, and therefore V=(K(ω)/ηL) |Δp|. Using all these equations, yields for the moisture layer width in units of the width cell:

$$a = \frac{1}{2} - \frac{1}{2}\sqrt{\frac{K(\omega)\Delta p}{GL}} \tag{4}$$

Which indicates that the moisture layer width will be minimum when K(ω) has its maximum possible value, i.e., when the viscoelastic fluid is displaced by pressure pulses to the optimum frequency.

Note that since we calculated the smaller possible width finger, it is "the worst" of the cases, i.e., the larger value possible of the moisture layer width. If any other finger width became stable, the moisture layer width could even be lower.

Definitions for the example v velocity t time p pressure r density h viscosity

G Rigidity module tr relaxation time, in the case of Maxwell fluid is given by tr=h/G b separation of the plates l finger width U finger end velocity V far away velocity of finger end, wherein flow is uniform Δp Pressure difference between cell ends L cell length A moisture layer width, for this example a=(1−l)/2 in width cell units K(ω) permeability As mentioned in the backgrounds for a porous medium, the ratio between pressure and velocity is described by Darcy Law, i.e., a equation as equation (2), where now K(ω) is the permeability of the porous medium. The equation for the average width of the moisture layer, would be described by an equation similar to the equation (4), where now $\Delta p$ would be pressure difference between a point where driving fluid is injected, ant the point where driven fluid exits, and L would be the distance between this two points. This equation would state that average width of the moisture layer is minimum when the viscoelastic fluid is displaced with pressure pulses to the frequency that gives the maximum value possible of the medium permeability.

The invention claimed is:

1. A process for driving a moisture layer reducing viscoelastic fluid between the viscoelastic fluid and the walls of the medium containing it, when the driving fluid has lower viscosity than the driven fluid, the process comprising:

injecting the low viscosity fluid to displace the viscoelastic fluid with a signal that contain pressure pulses at an optimum frequency, so that it communicates them to the viscoelastic fluid when being driven, with the corresponding injection of low viscosity fluid to replace the volume of driven fluid, choosing the optimum frequency by applying Darcy's Law.

2. The process according to claim 1, wherein the medium that contain the viscoelastic fluid is a pore, tube, duct, channel, fracture, porous medium or a interconnected latticework or interconnected set of pores, tubes, channels and/or fractures of equal or different geometries and equal or different sizes.

3. The process according to claim 2, wherein the porous medium is an oil well.

4. The process according to claim 2, wherein the porous medium is an oil well naturally fractured.

5. The process according to claim 1 wherein the pressure pulses are generated by mechanical, electromechanical, hydraulic, pneumatic, magnetic, optical, acoustical, thermoacoustical means, or any means generating vibrations.

6. The process according to claim 1, wherein the signal comprises only pressure pulses to the optimum frequency.

7. The process according to claim 1, wherein the signal is a signal at constant flow to which are overlapped pressure pulses at the optimum frequency.

8. The process according to claim 1, wherein the signal comprises a signal with constant pressure gradient, to which are overlapped pressure pulses at the optimum frequency.

9. The process according to claim 1, wherein the signal comprises any signal to which are overlapped pressure pulses at the optimum frequency.

* * * * *